US006971927B2

(12) United States Patent
Anbo et al.

(10) Patent No.: US 6,971,927 B2
(45) Date of Patent: Dec. 6, 2005

(54) CONNECTION TERMINAL

(75) Inventors: Tsugio Anbo, Tokyo (JP); Yukifumi Machida, Tokyo (JP); Shinji Yamaguchi, Tokyo (JP); Seiichiro Hayashi, Tokyo (JP); Nobuhiro Kimura, Kanagawa (JP)

(73) Assignees: Ryosei Electro-Circuit System, Ltd., Sagamihara (JP); Union Machinery Co., Ltd., Sagamihara (JP)

( * ) Notice: Subject to any disclaimer, the term of this patent is extended or adjusted under 35 U.S.C. 154(b) by 0 days.

(21) Appl. No.: 10/512,937

(22) PCT Filed: May 16, 2003

(86) PCT No.: PCT/JP03/06146

§ 371 (c)(1),
(2), (4) Date: Oct. 28, 2004

(87) PCT Pub. No.: WO03/098746

PCT Pub. Date: Nov. 27, 2003

(65) Prior Publication Data

US 2005/0153605 A1 Jul. 14, 2005

(30) Foreign Application Priority Data

May 17, 2002 (JP) ..... 2002-143072
May 17, 2002 (JP) ..... 2002-143073
May 17, 2002 (JP) ..... 2002-143074

(51) Int. Cl.[7] ..... H01R 13/11

(52) U.S. Cl. ..... 439/852

(58) Field of Search ..... 439/852, 851, 439/850, 843, 845, 839

(56) References Cited

U.S. PATENT DOCUMENTS

| | | | | |
|---|---|---|---|---|
| 4,919,628 | A | 4/1990 | Mobley et al. | |
| 6,024,612 | A | 2/2000 | Myer et al. | |
| 6,290,553 | B1 * | 9/2001 | Sato et al. | 439/843 |
| 6,447,345 | B2 * | 9/2002 | Sato et al. | 439/852 |

FOREIGN PATENT DOCUMENTS

| | | | |
|---|---|---|---|
| JP | 1-202328 | A | 8/1989 |
| JP | 8-111255 | A | 4/1996 |
| JP | 10-134872 | A | 5/1998 |
| JP | 2814927 | B2 | 8/1998 |

OTHER PUBLICATIONS

Microfilm of the Specification and Drawings Annexed to the Request of Japanese Utility Model Application No. 18778/1989 (Laid-open No. 110184/1990) The Furukawa Electric Co., Ltd., Sep. 4, 1990, Full text; Figs. 1-3.

* cited by examiner

*Primary Examiner*—Phuong Dinh
(74) *Attorney, Agent, or Firm*—Frishauf, Holtz, Goodman & Chick, P.C.

(57) ABSTRACT

In a connector terminal into which a cooperating male contact terminal can be smoothly inserted and a movable contact strip can be prevented from being buckled while a desired contact pressure can be attained, a connecting portion 11 is formed into a substantially box shape by folding a bottom plate 13, side plates 14, 15 (14 is not shown) continuously extending from respective sides of the bottom plate and a top plate 16 continuously extending from one of the side plates. A movable contact strip 17 is formed by folding back the top plate 16 around a gently curved portion 17*a* into a resilient spring having an inverted triangular shape including a contact portion 17*b* near an inwardly bent middle portion of the movable contact strip 17. A hole 17*c* is formed at an end portion of the movable contact strip 17 into which an engagement tip 16*b* formed by folding a part of the top plate 16 inwardly is inserted.

7 Claims, 4 Drawing Sheets

CONNECTION TERMINAL

This application is a U.S. National Phase Application under 35 USC 371 of International Application PCT/JP03/06146 filed May 16, 2003.

BACKGROUND OF THE INVENTION

1. Field of the Invention

The present invention relates to a connector terminal for use in a female connector to which a cooperating male connector is to be electrically connected.

2. Related Art Statements

The connector terminal of a kind mentioned above is generally formed by folding a single metal plate such that the connector terminal includes a connecting portion into which a connector terminal of a cooperating male connector is to be inserted and a wire clamping portion to which an electrical wire is to be connected by clamping.

FIG. 6 is a longitudinal cross sectional view showing a known connector terminal. A reference numeral 1 denotes a connecting portion into which a connector terminal of a male connector is to be inserted and a reference numeral 2 represents a wire clamping portion. The connecting portion 1 includes a bottom plate 3 having an inwardly protruding contact portion 3*a* formed therein, right and left side walls 4 and 5 (5 is not shown in the drawing) extending continuously from respective sides of the bottom plate 3, and a top plate 6 which extends continuously from one of the side plates, said bottom plate, side plates and top plate being formed to constitute a rectangular space. A rear portion of the top plate 6 is folded back to form a movable contact strip 7.

The movable contact strip 7 is bent into an inverted triangular shape having an apex at a contact portion 7*c* situating at a middle between a base portion 7*a* and a free end portion 7*b*. The free end portion 7*b* is brought into contact with an inner surface of the top plate 6 in a slidable manner. When a flat plate-like contact terminal of a cooperating male connector is inserted into a space formed between the contact portion 3*a* of the bottom plate 3 and the contact portion 7*c*, upper and lower surfaces of the contact terminal of the male connector are brought into contact with the contact portions 7*c* and 3*a*, respectively to form an electrical connection. In the top plate 6, there is formed a projection 6*a* which projects behind the contact portion 7*c* to prevent an excessive deformation of the movable contact strip 7.

When the flat plate-like connector terminal of the cooperating male connector not shown is inserted into the connecting portion, the movable contact strip 7 deforms resiliently and the connector terminal of the male connector is pushed by the contact portion 7*c*.

In the known connector terminal explained above, if a connector terminal of a cooperating male connector is inserted obliquely into the connecting portion 1, there might be produced a rather large frictional force at a contact point between a tip of the connector terminal of the male connector and an inclined portion of the movable contact strip 7, and the movable contact strip 7 is compressed in a longitudinal direction. Then, an inclination angle of the inclined portion of the movable contact strip 7 is increased, and therefore the frictional force becomes much larger. In this manner, the connector terminal of the male connector could not be inserted smoothly and the movable contact strip 7 might be buckled.

Particularly, in case of a multi-pole connector having a number of connector terminals installed in a common housing, if one of the connector terminals is not inserted, the whole connector terminals could not be inserted.

SUMMARY OF THE INVENTION

The present invention has for its object to provide a connector terminal which can overcome the above mentioned drawbacks of the known connector terminal, and can remove the undesired buckling of the movable contact strip, while a desired contact pressure can be attained.

According to the invention, a connector terminal formed by punching and folding an electrically conductive metal plate and including a connecting portion receiving a connector terminal of a cooperating connector and a wire clamping portion for connecting an electrical wire, said connecting portion including a bottom plate, side plates continuously extending from respective sides of the bottom plate and a top plate continuously extending from one of the side plates to form a rectangular box-shaped space surrounded by said plates, said connecting portion further comprising a movable contact strip formed by folding back a rear projection of the top plate along a boundary between the top plate and the movable contact strip, said movable contact strip being formed as a resilient spring having an inverted triangular shape by projecting a central portion of the movable contact strip inwardly; wherein a hole is formed at an end portion of the movable contact strip, and a part of the top plate near a front end is folded inwardly to form an engagement tip which is inserted into said hole formed in the end portion of the movable contact strip.

DESCRIPTION OF THE PREFERRED EMBODIMENTS

Figure 1:
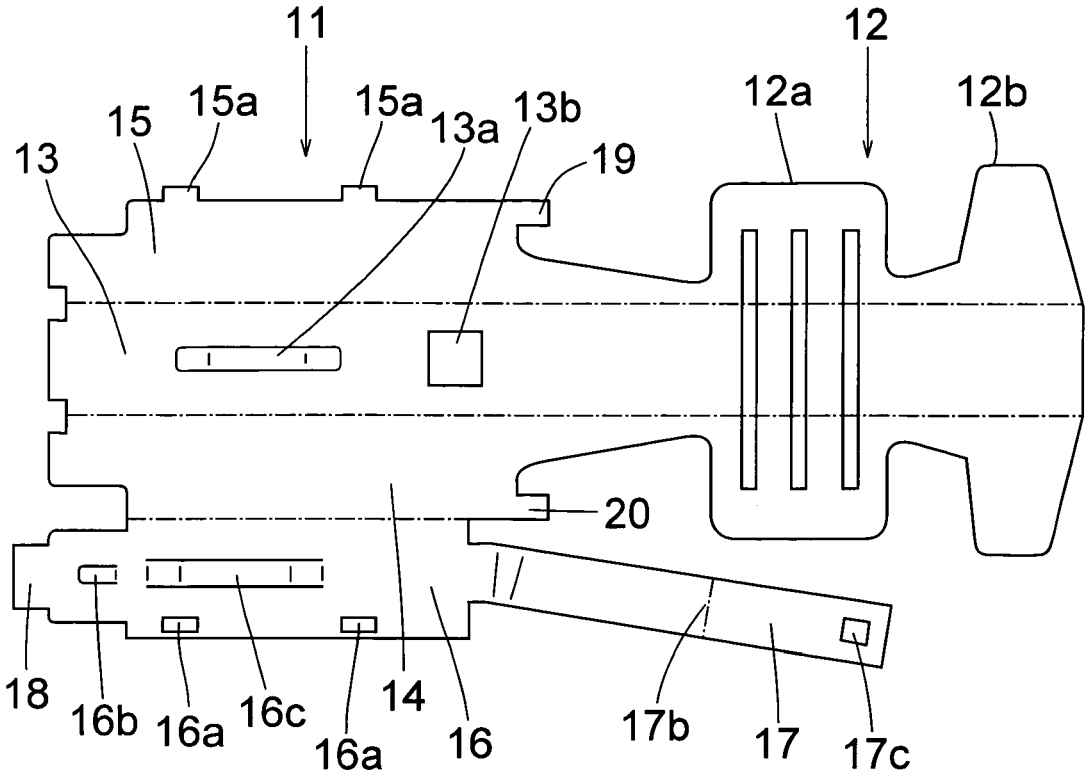
FIG. 1 is an exploded plan view showing an embodiment of the connector terminal according to the invention.
Figure 2:
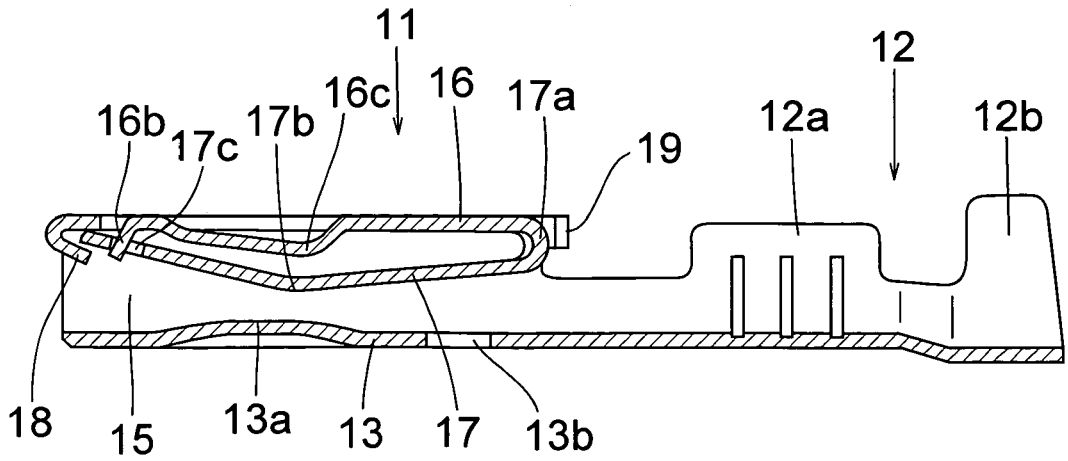
FIG. 2 is a longitudinal cross sectional view of the connector terminal.
Figure 3:
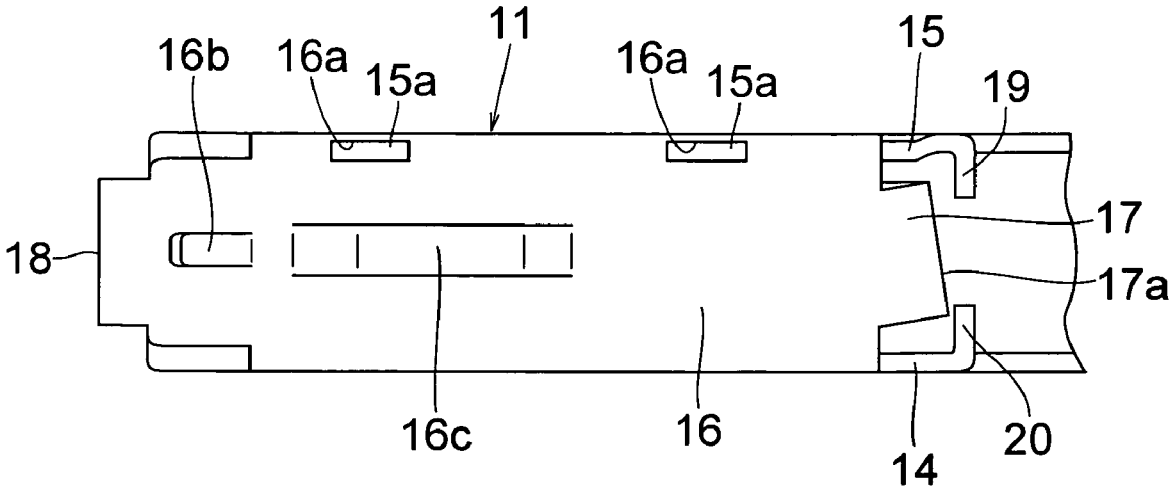
FIG. 3 is an expanded plan view illustrating a connecting portion of the connector terminal.
Figure 4:
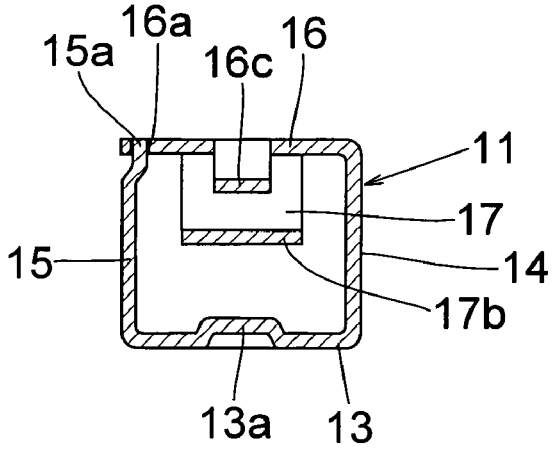
FIG. 4 is an expanded lateral cross sectional view of the connecting portion.

FIGS. 1 and 2 are exploded plan view and longitudinal cross sectional view, respectively showing an embodiment of the connector terminal according to the invention, FIG. 3 is an expanded plan view illustrating a connecting portion thereof, and FIG. 4 is an expanded lateral cross sectional view of the connecting portion. The connector terminal includes a connecting portion 11 and a wire connecting portion 12, all of which are formed by punching an electrically conductive metal plate as shown in FIG. 1 and folding various portions as illustrated in FIG. 2.

The connecting portion 11 is formed by folding the metal plate along chain lines shown in FIG. 1 to constitute a bottom plate 13, right and left side plates 14, 15 extending from respective sides of the bottom plate and a top plate 16 extending from one of the side plates 14. These plates are folded to constitute a substantially box-like member as illustrated in FIGS. 2–4. The wire clamping portion 12 includes a first clamping portion 12*a* for clamping a core conductor of an electrical wire and a second clamping portion 12*b* for clamping a sheath of the electrical wire.

In the bottom plate 13 there are formed a contact portion 13*a* which protrudes inwardly and a locking hole 13*b* into which a locking projection formed on a bottom of a housing is to be inserted. One or more slit-like locking holes 16*a* are formed in the top plate 16 at positions near a side edge which is brought into contact with the side plate 15, and locking projections 15*a* having a height equal to a thickness of the metal plate are inserted into the locking holes 16*a* upon folding.

A movable contact strip 17 is formed at a rear portion of the top plate 16 as shown in FIG. 1, said movable contact strip being inclined with respect to the top plate. The movable contact strip 17 is folded back inwardly about a boundary line between the top plate 16 and the contact strip 17 as depicted in FIG. 2 to form a gently curved portion 17*a*. The contact strip 17 is bent into an inverted triangular shape having an apex at a contact portion 17*b* near a central portion of the movable contact strip 17. In this manner, the movable contact strip 17 is formed to serve as a resilient leaf spring. At a front end portion of the movable contact strip 17 there is formed a hole 17*c* into which an engagement projection 16*b* formed by folding a part of the top plate 16 is to be inserted.

A front end portion 18 of the top plate 16 is folded inwardly such that a front end of the movable contact strip 17 is surrounded by the front end portion 18 to prevent the engagement projection 16*b* from being removed from the hole 17*c* when the movable contact strip 17 is moved. Moreover, the folded front end portion 18 serves as a guide for a connector terminal of a cooperating male connector. In the top plate 16 there is further formed a projection 16*c* which projects inwardly toward the movable contact strip 17 such that the projection 16*c* can serve to limit an excessive deformation of the movable contact strip 17.

As illustrated in FIG. 1, at rear portions of the side plates 14 and 15 there are formed relatively small locking strips 19 and 20. Upon assembling, the locking strips 19 and 20 are folded inwardly to situate behind the gently curved portion 17*a* of the movable contact strip 17.

Figure 5:
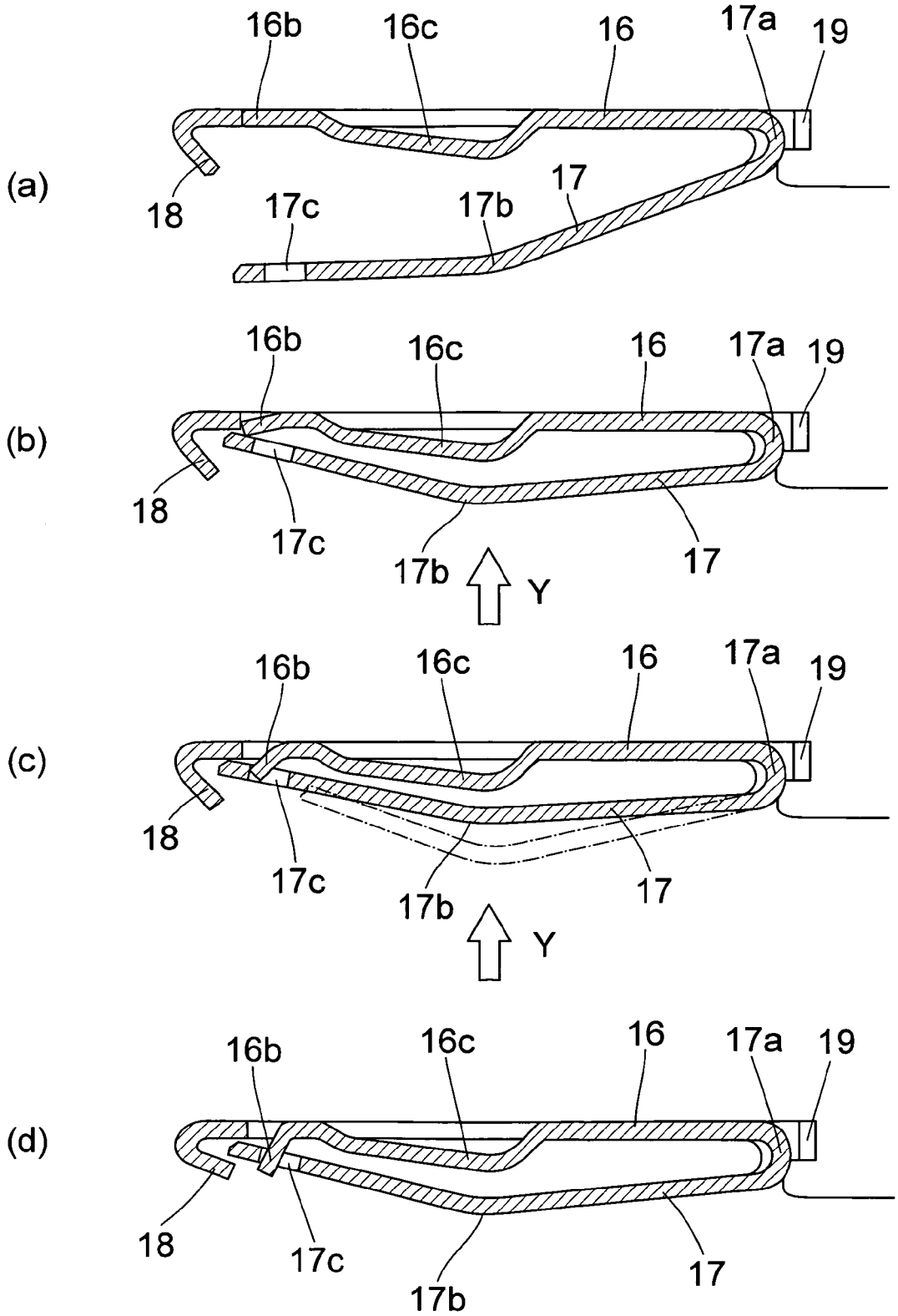
FIGS. 5*a*–5*d* are explanatory cross sectional views showing a manner of forming a movable contact strip of the connector terminal.
Figure 6:
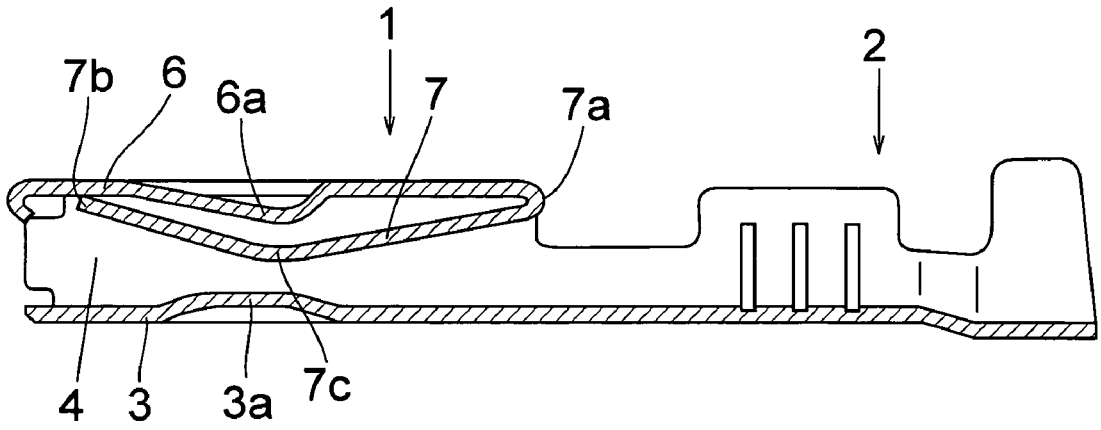
FIG. 6 is a longitudinal cross sectional view depicting a known connector terminal.

The connector terminal is formed by a forming press via a number of punching and folding steps, and the movable contact strip 17 is arranged into a given position by means of successive steps shown in FIG. 5. At first, as shown in FIG. 5(*a*), the movable contact strip 17 having the previously formed contact portion 17*b* is folded back to form the contact portion 11 into a box shape. During this step, the movable contact strip 17 is pushed upward in a direction Y to move the front end of the movable contact strip 17 toward the top plate as shown in FIG. 5(*b*). Next, as depicted in FIG. 5(*c*), the engagement projection 16*b* formed in the top plate 16 is inserted into the hole 17*c* formed at a front end portion of the movable contact strip 17. After inserting the engagement projection 16*b* into the hole 17*c*, the front end portion 18 of the top plate 16 is further bent to embrace the free end portion of the movable contact strip 17 as illustrated in FIG. 5(*d*). Then, the engagement projection 16*b* can be prevented from being removed from the hole 17*c* even when the movable contact strip 17 is deformed.

Next, the side plates 14 and 15 are bent into upright position, and then the top plate 16 is bent. During this process, the locking strips 19 and 20 formed in the side plates 14 and 15, respectively are bent inwardly as shown in FIG. 3, and the locking projections 15*a* provided on the free side of the side plate 15 are inserted into the locking holes 16*a* formed in the top plate 16 as depicted in FIG. 4.

When the connector terminal is installed within a housing made of a synthetic resin, a locking projection formed on a bottom of the housing is inserted into the locking hole 13*b* formed in the bottom plate 13, and locking lances formed on the housing are engaged with the locking strips 19 and 20. In this manner, the connector terminal is fixed in position within the housing, and the connector terminal can be effectively prevented from being removed in the forward direction as well as in the backward direction.

In the connector terminal according to the invention, the engagement projection 16*b* formed in the top plate 16 is inserted into the hole 17*c* formed in the movable contact strip 17 and the backward movement of the movable contact strip 17 can be effectively prevented. Therefore, upon inserting a flat plate-like connector terminal of a cooperating male connector into a space formed between the contact portion 17*b* of the movable contact strip 17 and the contact portion 13*c* of the bottom plate 13 of the connector terminal according to the invention, even if the movable contact strip 17 is pushed backward due to a frictional force generated between the inserted connector terminal and the inclined portion of the inverted triangle of the movable contact strip 17, the movable contact strip 17 can be prevented from being compressed backwardly and the connector terminal of the cooperating male connector can be smoothly inserted into the connecting portion of the connector terminal according to the invention.

Moreover, even when the connector terminal of the cooperating male connector is inserted obliquely and a relatively large frictional force is generated between the inserted connector terminal and the movable contact strip 17, the movable contact strip 17 can be effectively prevented from being buckled.

After the connector terminal of the cooperating male connector has been fully inserted, the inserted connector terminal can be clamped between the contact portion 17*b* of the movable contact strip 17 which serves as a leaf spring having a flexure point at the gently curved portion 17*a* and the contact portion 13*a* of the bottom plate 13, and therefore a desired electrical connection can be attained positively.

Furthermore, in case of a multiple-pole connector having a number of connector terminals installed within a common housing, the inserting operation can be remarkably improved, because a difference in inserting force of the connector terminals can be reduced.

In the above explained embodiment of the connector terminal according to the invention, upon installing the connector terminal within the housing, the locking lances formed in the housing can be prevented from being brought into contact with the base portion 17*a* of the movable contact strip 17 and therefore can be stably engaged with the locking projections 19 and 20 formed in the side plates. Moreover, a stress is not concentrated to the base portion 17*a* of the movable contact strip 17, and thus undesired deformation of the strip near the base portion can be prevented.

It should be noted that the locking projections 19 and 20 may be extended not from the side plates 14 and 15, but from the top plate 16 at both sides of the base portion 17*a* of the movable contact strip 17. Furthermore, the present invention may be applied to the connector terminal without the movable contact strip.

As explained above, in the connector terminal according to the invention, undesired buckling of the movable contact strip can be effectively prevented upon insertion of a connector terminal of a cooperating male connector, the inserting operation can be performed stably, and a sufficient large contact pressure can be attained.

What is claimed is:

1. A connector terminal formed by punching and folding an electrically conductive metal plate and including a connecting portion receiving a connector terminal of a corresponding connector and a wire clamping portion for connecting an electrical wire, said connecting portion including a bottom plate, side plates continuously extending from respective sides of the bottom plate and a top plate continuously extending from one of the side plates to form a rectangular box-shaped space surrounded by said plates, said connecting portion further comprising a movable contact strip formed by folding back a rear projection of the top plate along a boundary between the top plate and the movable contact strip, said movable contact strip being formed as a resilient spring having an inverted triangular shape by projecting a central portion of the movable contact strip inwardly; wherein a hole is formed at an end portion of the movable contact strip, and a part of the top plate near a front end is folded inwardly to form an engagement tip which is inserted into said hole formed in the contact strip.

2. The connector terminal according to claim 1, wherein said movable contact strip is pulled forward and said engagement tip is resiliently inserted into said hole such that a backward movement of the movable contact strip is prevented by said engagement tip.

3. The connector terminal according to claim 1, wherein the front end of the top plate is folded inwardly such that the front end of the movable contact strip is held by the front end portion of the top plate and the engagement tip is prevented from being removed from said hole.

4. The connector terminal according to claim 1, wherein said connecting portion further includes locking strips formed at rear ends of the side plates, said locking strips being engaged with locking lances formed on a housing.

5. The connector terminal according to claim 4, wherein said locking strips are formed by bending inwardly projections extending continuously from the rear ends of the side plates.

6. The connector terminal according to claim 1, wherein at least one engagement projection is formed on a free side of the other of said side plates and at least one engagement hole is formed in a free side of said top plate, said engagement projection being inserted into said engagement hole to couple said top plate and said other side plate with each other such that said top plate, side plates and bottom plate form a substantially rectangular hollow tube.

7. The connector terminal according to claim 6, wherein more than two engagement projections and more than two engagement holes are provided.

* * * * *

UNITED STATES PATENT AND TRADEMARK OFFICE

CERTIFICATE OF CORRECTION

PATENT NO. : 6,971,927 B2
APPLICATION NO. : 10/512937
DATED : December 6, 2005
INVENTOR(S) : Tsugio Anbo et al.

It is certified that error appears in the above-identified patent and that said Letters Patent is hereby corrected as shown below:

Title Page and Column 1
Item (54) Title, change "CONNECTION" to
--CONNECTOR--;

Title Page
Item (73) Assignees, line 2, change "Sagamihara"
to --Tokyo--,
line 3, change "Sagamihara"
to --Kanagawa--;

Column 6, after line 24 (after claim 7),
insert --8. The connector terminal according to claim 2, wherein the front end of the top plate is folded inwardly such that the front end of the movable contact strip is held by the front end portion of the top plate and the engagement tip is prevented from being removed from said hole. --

Signed and Sealed this

Thirtieth Day of October, 2007

JON W. DUDAS
*Director of the United States Patent and Trademark Office*